United States Patent [19]

Edwards

[11] Patent Number: 4,919,686

[45] Date of Patent: Apr. 24, 1990

[54] PROCESS FOR THE PYROLYTIC PRODUCTION OF SYNTHETIC GAS

[75] Inventor: Raymond S. Edwards, Scottsdale, Ariz.

[73] Assignee: Co-Gen Power Corporation, Phoenix, Ariz.

[21] Appl. No.: 102,838

[22] Filed: Sep. 30, 1987

Related U.S. Application Data

[63] Continuation-in-part of Ser. No. 918,310, Oct. 14, 1986, abandoned.

[51] Int. Cl.[5] ..... C10J 3/00

[52] U.S. Cl. ..... 48/197 R; 48/111; 48/209; 201/6; 201/8; 201/25; 585/240; 585/242

[58] Field of Search ..... 48/209, 111, 86 R, 197 R; 201/6, 8, 25; 585/240, 241, 242

[56] References Cited

U.S. PATENT DOCUMENTS

| | | | |
|---|---|---|---|
| 3,579,320 | 5/1971 | Pesses | 48/209 |
| 3,714,038 | 1/1973 | Marsh | 48/209 |
| 3,736,111 | 5/1973 | Gardner et al. | 48/209 |
| 3,832,151 | 8/1974 | Kitaoka et al. | 48/209 |
| 3,841,851 | 10/1974 | Kaiser | 48/209 |
| 3,926,582 | 12/1975 | Powell et al. | 48/209 |
| 4,038,152 | 7/1977 | Atkins | 48/111 |
| 4,225,392 | 9/1980 | Taylor | 48/85 |
| 4,398,476 | 8/1983 | Suzuki et al. | 201/25 |
| 4,557,204 | 12/1985 | Foehnle | 48/209 |
| 4,650,546 | 3/1987 | LeJeune | 201/6 |

*Primary Examiner*—Peter Kratz

*Attorney, Agent, or Firm*—Dick and Harris

[57] ABSTRACT

A method for the pyrolytic production of synthetic gas from components of solid materials, including selected segregated post-consumed waste materials, within a pyrolytic gasifier operably heated by an associated furnace, which includes the steps of: preparing the materials for use as furnace fuel; preparing the materials for use as pyrolytically decomposable gassifier fuel by material proparation means; conveying the materials from the material preparation means to material segregation means by material conveying means operably associated therebetween; segregating the materials into selected segregated components of the gassifier fuel by the material segregation means; delivering the components of gasifier fuel into a desired gasifier fuel formula component ratio by gasifier fuel delivery means so as to comprise a gasifier fuel formula mixture; and compacting the gasifier fuel mixture by compacting means operably connected to gasifier fuel delivery means, so as to substantially eliminate entrapped oxygen and nitrogen within the gasifier fuel mixture which prevents the potential for oxygenated combustion thereof, and assists in producing a clean product of synthetic gas.

52 Claims, 5 Drawing Sheets

PROCESS FOR THE PYROLYTIC PRODUCTION OF SYNTHETIC GAS

BACKGROUND OF THE INVENTION

The present application is a Continuation-In-Part of application Ser. No. 06/918,310 filed on Oct. 14, 1986and now abandoned. The present invention relates in general to a device for the production of synthetic gas from plastic and paper materials and in particular to a method for producing and collecting synthetic gas from selected segregated post-consumed waste plastic and paper products by a process of pyrolytic gasification, as further described herein. In recent years, there as been considerable discussion regarding the finite and diminishing supply of natural fuel resources such as natural gas, and the need for conservation of such fuel resources and the development of synthetic fuel alternatives.

While apparata have previously existed for attempting to produce such synthetic gas, such devices have not produced synthetic gasses having energy ratings which approach the approximately 950–1000 BTU/ft.$^3$ rating of natural gas obtained from natural wells. Likewise, such devices have not adequately addressed the problem of proper compaction of the fuel being gasified, so as to sufficiently eliminate any entrapped oxygen and nitrogen comprising the constituents of air, which can result in destructive detonation resulting from the presence of entrapped oxygen in the fuel during the high temperature heating of the fuel mixture. Failure to remove such entrapped nitrogen, (which is a non-combustible gas,) from the fuel being gasified would serve to allow the nitrogen to mix with the produced gas, serving to lower its BTU content. Prior art devices have employed rotary-air lock and auger type fuel feed systems to attempt to prevent the introduction of air into the fuel mixture, but have not successfully addressed the removal of any oxygen and nitrogen that may be entrapped in the fuel mixture.

Accordingly, the present invention has as one of its objects, the provision of a method of enabling selected segregated post-consumed waste plastic and paper materials to be recycled and pyrolytically gasified into a clean, high grade fuel in the form of synthetic gas.

It is additionally an object of the present invention to provide such a method for producing synthetic gas in which the process is approximately 94% efficient, as compared to conventional methods or gas production which vary from approximately 65% to 80% efficiency, so as to recycle a high proportion of petroleum based plastic products into the form of usable fuels such as synthetic gas and a usable petroleum distillate.

It is further an object of the present invention to provide such a method for producing synthetic gas wherein the fuel being pyrolytically gasified has all but approximately 1% of the entrapped oxygen and nitrogen removed from it by hydraulic, high pressure densification to above 60 lb/ft$^3$ unit density.

Yet another object of the present invention is to provide such a method for producing synthetic gas, which enables the use of selected segregated post-consumed waste materials, such as wood products and paper products to fuel the furnace portion of the furnace-gasifier.

It is further an object of the present invention to provide such a method for producing synthetic gas in which the synthetic gas produced has a rating as high as approximately 1920 BTU/ft.$^3$, as compared to the approximately 660 BTU/ft.$^3$ and lower rating for conventional methods of producing synthetic gas. Yet another object of the present invention is to provide such a method for producing synthetic gas, in which the furnace exhaust produced during the heating of the gasifier for the gasification process is treated before being released into the atmosphere, so as to avoid polluting the environment. The heat produced during full combustion in the furnace portion can be utilized in a heat exchanger for the production of steam or heated air. Also, passing the furnace exhaust through an absorption chiller can be used to produce cooled air.

These and other objects of the invention will become apparent in light of the present specification, drawings, examples and claims.

SUMMARY OF THE INVENTION

This invention comprises a method for the pyrolytic production of synthetic natural gas from components of solid, light unit density (below 30 lb/ft $^3$) and high unit density (above 30 lb/ft$^3$) materials, including selected segregated postconsumed waste paper and plastic materials, within a gasifier operably heated by an associated furnace and which comprises the steps of: preparing the plastic and paper materials for use as pyrolytically decomposable gasifier fuel by material preparation means; conveying the materials from the material preparation means to material segregation means by material conveying means operably associated therebetween; segregating the materials into segregated components of the gasifier fuel by the material segregation means; delivering the components of gasifier fuel into a desired gasifier fuel formula component ratios by gasifier fuel delivery means so as to comprise a formulated gasifier fuel mixture as later described; and densifying the gasifier fuel mixture to minimum density of approximately 60 lb/ft$^3$ by compacting means operably connected to gasifier fuel delivery means, so as to substantially eliminate entrapped oxygen and nitrogen within the formulated gasifier fuel mixture.

In addition, the invention comprises the steps of heating, through heat transfer, the interior of the gasifier means by the furnace means to a desired temperature between 700° F. and 950° F.; conveying the gasifier fuel mixture from the storage hopper to the gasifier feed means by the conveying means operably associated therewith; feeding the desired ratio of densified formulated gasifier fuel mixture into the gasifier means; directing the densified gasifier fuel mixture disks within the gasifier towards the exterior periphery of the gasifier to facilitate the formation of the synthetic gas through the pyrolytic decomposition of the densified gasifier fuel mixture disks therewithin; and, collecting the synthetic gas formed within the gasifier means by the pyrolytic decomposition of the gasifier fuel mixture, by gas collection means operably associated with the gasifier means, with the gas collection means channeling the synthetic gas component to gas collection means.

In addition, the aforementioned method can further comprise the operation of: preparing one or more of the selected segregated post-consumed plastic and paper materials by the material preparation means for simultaneous use as burnable furnace fuel; mixing the components of furnace fuel into a furnace fuel mixture by furnace fuel mixing means; conveying the furnace fuel mixture from the mixing means to furnace feed means by the material conveying means; feeding the furnace fuel mixture into the furnace means by the furnace feed means; igniting the furnace fuel mixture by ignition means so as to commence sustained combustion of the furnace fuel mixture within the furnace means; and burning the furnace fuel mixture within the furnace means so as to heat the furnace means to a desired temperature between 1550° F. and 1750° F., thereby converting the furnace fuel mixture to ash and exhaust gasses, prior to the operation of feeding the formulated gasifier fuel mixture disks into the gasifier means.

Similarly, the method can further comprise the operation of injecting air into the furnace means by combustion air blower means operably associated with the furnace means, for substantially even combustion of the furnace fuel mixture within the interior of the furnace means.

The invention can further include the step of removing of the furnace fuel ash from the furnace means by the ash removal means operably associated with the furnace means. In addition, the method can further comprise the operation of removing of the furnace fuel combustion exhaust gasses from the furnace means through exhaust means operably associated therewith. Also, the method can further comprise the operation of removing the gasifier fuel char from the gasifier means by solid removal means operably associated with the gasifier means.

The invention can further include the operation of cooling the produced synthetic gas by gas cooling means operatively interposed between the gasifier means and the synthetic gas collection means. Furthermore, the method can further comprise the operation of filtering the synthetic gas so as to trap and retain substantially all particulates and moisture present herein by synthetic gas filtering means operatively interposed between the cooling means and the synthetic gas collection means. Likewise, the invention can further comprise the operation of pumping the synthetic gas from the gasifier means to the synthetic gas storage means by pump means operatively interposed therebetween.

Yet another operation which can be included in the invention, comprises the operation of filtering the exhaust gasses so as to trap and retain substantially all particulates present therewithin, by exhaust gas filter means operatively associated with the gas exhaust means. The heat produced during combustion can be utilized in a heat exchanger for the production of steam or heated air. Also, an absorption chiller can be used to produce cooled air. Alternatively, the operation of directing the gasifier fuel mixture can further comprise mixing of a fuel mixture by gasifier feed means. Similarly, the invention can also include the operation of preparing the materials so as to include the pre-sorting of the furnace fuel materials to remove all non-burnable materials therefrom. In the preferred embodiment, the operation of preparing the materials comprises: shredding to approximately 4" minus the light unit density materials by shredder means; grinding to approximately 4" minus the high unit density materials by hammermill means; and conveying the shredded light unit density materials and the ground high unit density materials to pulverizing means by the conveying means operably associated with the shredder means and the hammermill means.

The material preparation means comprises shredder means operably associated with the conveying means so as to receive light unit density materials of less than 30 lb/ft$^3$ unit density from the conveying means at an input side of the shredder means and to shred the light unit density materials within the interior of the shredder means prior to the exiting of the materials from the shredder means through an exit side thereof. Hammermill means are also operably associated with the conveying means so as to receive the high unit density materials of more than 30 lb/ft$^3$ from the conveying means at an input side of the hammermill means and grind the high unit density materials within the interior of the hammermill means, prior to exiting the hammermill means through an exit side thereof. Pulverizer means are operably associated with the conveying means so as to be capable of receiving a preselected component combination of the shredded light unit density materials and the ground high unit density materials at an input side of the pulverizer means and pulverize the materials within the interior thereof to approximately $\frac{3}{8}$" minus, prior to exiting the pulverizer means through an exit side thereof. Magnet means are also operably associated with one or more of the conveyer means for removing any ferrous metallic objects present in the materials. Control means are also operatively associated with the conveyor means, the shredder means and the hammermill means so as to enable selection of the amount and proportions of the shredded light unit density material and the ground high unit density material which reaches the pulverizer means.

The shredder means comprises a fixed blade shredder capable of reducing the light unit density materials to a non-uniform consistency of 4" minus in size. The light unit density materials comprise: selected segregated post-consumed paper material formed of a combination of cellulose products; and light unit density selected segregated post-consumed plastic material formed of a combination of specifically selected plastic sheet and plastic containers. The high unit density materials comprise wood material formed of a combination of wooden planks, wooden cases, wooden pallets, tree branches and high unit density plastic materials formed of plastic cases, plastic mouldings and plastic pallets. Specifically excluded are plastics formed or molded from poly-vinyl chloride because during the gasification process such materials could produce lethal gases.

The pulverizer means, in the preferred embodiment, is a pulverizer capable of reducing the size of the light and heavy unit density materials to particles of less than approximately $\frac{1}{4}$" minus in size. The hammermill means comprises a fixed blade type hammermill capable of reducing the high unit density materials to a non-uniform particle of 4" minus in size. The magnet means comprises a first magnetic head pulley operably associated with the conveying means proximate the hammermill means and a second magnetic head pulley operably associated with the conveying means proximate the shredder means so as to substantially remove the ferrous metal objects from the materials.

The material conveying means comprises a first conveyor means operably associated with the input side of the shredder means for conveying the light unit density materials into the input side of the shredder means. Second conveyor means are operably associated with the hammermill means for conveying the high unit density materials to the input side of the hammermill means. Third conveyor means operably associated with the exit sides of the shredder means and the hammermill means are provided for conveying the shredded light unit density material and the ground high unit density material to the input side of the pulverizer means.

Fourth conveyor means are operably associated with the exit side of the pulverizer means for conveying the pulverized materials to the fuel component mixing means, while fifth conveyor means are operably interposed between the fuel component mixing means and the furnace fuel hopper means for conveying the furnace fuel mixture to the furnace fuel hopper means. The sixth conveyor means are operably interposed between the fuel component mixing means and the gasifier fuel hopper means for transporting the gasifier fuel mixture to the gasifier fuel hopper means and a seventh conveyor means is operably interposed between the gasifier fuel hopper means and the gasifier feed means for conveying the formulated gasifier fuel mixture to the gasifier feed means. The eight conveyor means are operably interposed between the furnace fuel hopper means and the furnace fuel feed means for conveying the furnace fuel mixture to the furnace fuel feed means.

In the preferred embodiment, the first, second and third conveyor means comprise substantially flat belt conveyors. The fourth conveyor means each comprises a screw feed conveyor, while the fifth and sixth conveyor means each comprise a screw feed conveyor operably associated with a bucket elevator conveyor, or the like. The fifth and sixth conveyor means are operably equipped with drop out doors for alternatively filling the fuel hopper means. The seventh and eighth conveyor means comprise screw feed conveyors.

The material segregation means comprises a blower operably associated with the exit side of a pulverizer means. Centrifuge means are operably associated with a blower means so as to receive the materials from the pulverizer means and separate the pulverized materials from the surrounding air. At least one distribution chute is provided for receiving the separated pulverized materials and at least one storage hopper is associated with each of the distribution chutes for receiving the separated pulverized materials. Control means are operably associated with the centrifuge means and the distribution chutes so as to control the direction of the separated pulverized materials into desired storage hoppers. The fuel component mixing means comprises at least one metering mechanism operably associated with the storage hoppers to release a preselected amount of the pulverized materials contained within the hoppers so as to yield the preselected, desired furnace fuel mixture and the desired gasifier formulated fuel mixture.

The gasifier fuel compacting means comprises one or more hydraulic ram assemblies operatively associated with the gasifier means for densifying the formulated gasifier fuel mixture immediately prior to feeding the fuel mixture disks into the interior of the gasifier means. The compaction means densifies the gasifier fuel mixture to between 60 and 90 lb/ft$^3$ unit density, thereby removing all entrapped air (including oxygen and nitrogen). This will prevent such disks from burning. Moreover, failure to remove the entrapped nitrogen, which is a non-combustible gas, will allow the nitrogen to mix with the produced synthetic gas, so as to lower its BTU content. In addition, the compacting means can also further comprise pelletizer means comprising a forming die operatively associated with the conveying means so as to initially compress the gasifier fuel mixture into pellets between the delivery means and the gasifier feed means, and then extrude the gasifier fuel mixture into the gasifier means.

The hydraulic ram means comprises one or more outwardly extending housing or sleeves operably affixed to the outer periphery of the gasifier fuel feed tray and communicating with the interior of the gasifier means. A platten member is operably positioned within each of the sleeves. The platten member has one or more air release vents formed therein, for releasing entrapped air (oxygen and nitrogen) from the fuel mixture during densification. A hydraulic cylinder for selectively extending and retracting the platten member is attached to the outwardly extending housings.

The furnace means comprises a furnace housing being positioned proximate to the gasifier for heating a gasifier chamber within same. The furnace chamber substantially surrounds the gasifier chamber for burning of the furnace fuel within the furnace housing. The furnace chamber has a substantially cylindrical interior and a furnace liner substantially lining its interior. The furnace liner is made of a refractory material. Furnace fuel intake means are provided for receiving the furnace fuel for burning thereof. Combustion air intake means are operably associated with the furnace means for injecting air into the furnace chamber and causing a substantially cyclonic air flow pattern within the furnace chamber. Furnace exhaust means are operably associated with the furnace chamber so as to enable removal of furnace fuel exhaust therefrom.

Alternatively, the heating of a gasifier means can be accomplished by solar power substantially surrounding the gasifier means.

The gasifier chamber of the preferred embodiment further comprises gasifier mixing means operably positioned within the gasifier chamber so as to mix and circulate the densified gasifier fuel disks. Gasifier fuel char removal means are operably positioned within the gasifier chamber so as to enable facilitated removal of the gasifier fuel char from the gasifier. Gasifier fuel intake means are provided for receiving the gasifier fuel for pyrolytic gasification thereof within the gasifier chamber and synthetic gas escape means are operably positioned proximate the top of the gasifier chamber so as to enable the synthetic gas to escape from the gasifier.

The gasifier mixing means comprises a drive shaft means extending through the interior of the gasifier chamber. A plurality of paddle members are operably positioned about the periphery of the drive shaft means, coaxially with respect to the central axis of the gasifier chamber. Motor means are also provided operably associated with the drive shaft means so as to rotate the shaft means and the paddle members within the gasifier chamber.

The gasifier fuel char removal means comprises a char removal opening proximate the lower portion of the gasifier chamber. A char removal tube operably communicates with the gasifier chamber char removal opening so as to enable the char to pass from the gasifier chamber to the interior of the char removal tube. Air sealing means are operably associated with the char removal tube to prevent the undesired entry of air into the gasifier chamber through the char removal tube. Solid char removal means are operably associated with the char removal tube proximate an open first end of the tube for conveying the gasifier char from the furnace means. In operation, the furnace ash is compacted and forms plugs similar in consistency to the fuel mixture entering the gasifier. Hydraulic cylinder means are operably positioned within the interior of the char removal tube proximate an opposite second end of the tube, so as to enable the hydraulic cylinder means to push the gasifier fuel char from the char removal tube to the solid furnace ash removal means.

The furnace ash removal means comprises an auger conveyor and motor means operably associated with the auger conveyor for rotating the inclined auger conveyor. The air sealing means comprises a one-way flap valve operably positioned within the interior of the char removal tube.

The gasifier fuel intake means comprises one or more gasifier fuel feed ports positioned about the periphery of and operably communicating with the interior of the gasifier chamber proximate the top portion thereof. A synthetic gas escape means comprises the gasifier chamber having an opening proximate the top thereof.

The furnace means further comprises grate means operably positioned along the bottom surface of the furnace chamber. Wiper means are operably associated with the grate means so as to enable substantially continuous clearing of the grate means and permit the furnace ash to pass therethrough. Solid furnace ash removal means are operably positioned below the grate means so as to receive the furnace ash and convey it away from the furnace means. The furnace chamber has an exhaust opening along the back side and proximate the top of the furnace chamber. An exhaust tube operably communicates with the furnace chamber opening and a damper blade valve means is operably positioned within the exhaust tube so as to enable selective blockage of the exhaust tube.

The combustion air intake means comprises the furnace chamber having an opening proximate the bottom thereof capable of accommodating a blower tube for the injection of combustion air into the furnace chamber. The furnace chamber opening is further capable of accommodating insertion and receipt of a flame or ignitor for initially igniting the furnace fuel material.

The furnace fuel feed means comprises the furnace chamber having a furnace fuel intake opening proximate the top of the furnace chamber. The furnace fuel feed conduit operably connects to the furnace fuel intake opening. The furnace fuel feed conduit has an upwardly exposed open portion. The furnace fuel feed hopper operably attaches to the upwardly exposed open portion of the furnace fuel feed conduit. Auger conveyor means are operably associated within the interior of the furnace fuel feed conduit, while motor means are operably associated with the auger conveyor means, so as to drive the auger conveyor means and transfer the furnace fuel from the furnace fuel feed hopper to the furnace fuel intake opening.

The gasifier fuel feed means comprises a gasifier fuel tray means operably positioned about the upper top periphery of the furnace housing. The gasifier fuel tray has substantially hollow upper and lower chambers. Gasifier paddle means are operably positioned within the interior of the upper chamber of the gasifier fuel tray for moving the gasifier fuel about the interior. The gasifier fuel tray upper chamber has an interior channel with one or more substantially vertical chutes being formed in the interior channel. The gasifier fuel tray lower chamber has one or more lower compaction areas communicating with the substantially vertical chutes. The hydraulic ram means are operably positioned proximate to the lower compaction area so as to densify and inject the gasifier fuel disks into the gasifier chamber through one of the gasifier fuel feed ports.

The gasifier paddle means comprises a plurality of paddle members positioned substantially across the width of the interior of the upper chamber of the gasifier fuel tray in the interior channel. Gear means are operably affixed to the plurality of paddle members. Motor means are operably associated with the gear means so as to drive the paddle members along the interior of the gasifier fuel tray.

The gear means comprises one or more gear members and a continuous chain member operably moved within the channel by the one or more gear members. The continuous chain member is operably attached to each of the plurality of paddle members. The one or more gear members include a primary gear operably attached to the motor means which engages the chain member so as to move the chain member in response to rotation of the primary gear. One or more secondary gears are rotatably affixed within the upper channel so as to engage and support the chain member therein.

The synthetic gas collection means comprises a synthetic gas exhaust pipe operably affixed at the first end to the gasifier chamber, so as to communicate with the synthetic gas escape opening in the gasifier chamber. Particulate removal means are operably associated with the second end of the pipe for initial filtering of the synthetic gas. Gas cooler means are operably associated with the particulate removal means for cooling of the gas to ambient temperature, so as to substantially remove any distilled liquid hydrocarbons present in the gas after the initial filtration thereof. Secondary filtration means are operably associated with the gas cooler means for secondary filtration of the gas after removal of the liquid hydrocarbons. Vacuum pressure pump means are operably associated with the gas filtration means for drawing, under negative pressure, the gas from the gasifier chamber. One or more gas storage tanks are operably associated with the pump means for storing the gas drawn from the gasifier chamber in compressed form, or means for utilizing the gas on site. A flare tube is operably associated with the pump means for burning said synthetic gas in emergency situations.

Particulate removal means comprising a filter assembly having fabric material media are also provided. The gas cooler means comprises a cooling tube assembly for cooling the synthetic gas passing therethrough The filtration means comprises a plurality of industrial media filters which can be of the triple element variety. The pump means comprises a hydraulically powered vacuum pressure pump.

The gasifier fuel formulation can comprise a mixture of approximately 1% to 25% by weight of the selected plastic product materials with approximately 99% to 75% by weight respectively, consisting of selected paper product materials. Alternatively, the gasifier fuel formulation can comprise a mixture of approximately 26% to 50% by weight of the selected plastic product materials with approximately 74% to 50% by weight, respectively, consisting of the selected paper product materials.

As another alternative, the gasifier fuel formulation can comprise a mixture of approximately 50% to 99% by weight of the selected plastic product materials with approximately 49% to 1% by weight, respectively, consisting of the selected paper product materials. Also, the gasifier fuel can comprise only plastic product materials.

DETAILED DESCRIPTION OF THE DRAWINGS

Figure 1:
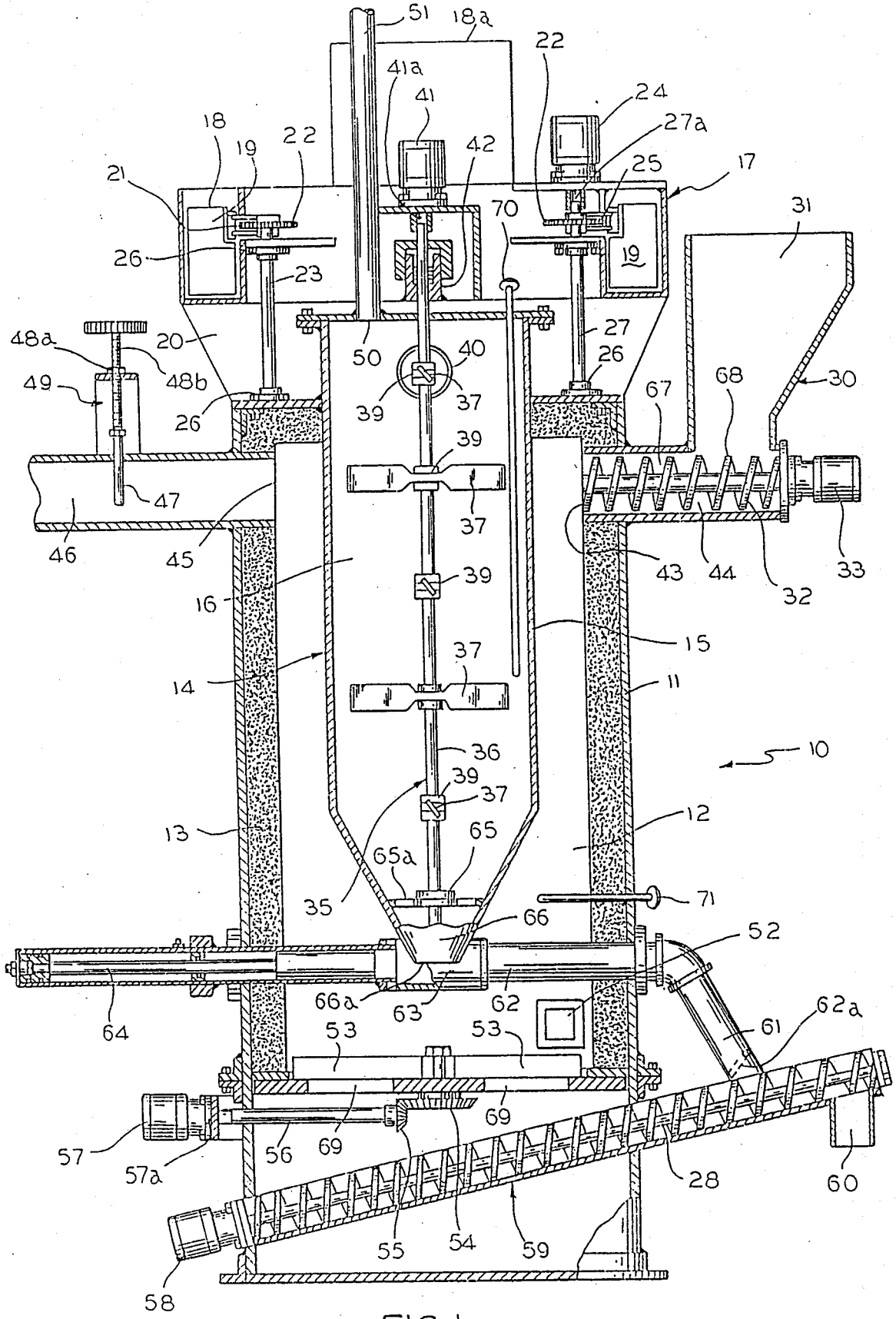
FIG. 1 is a side cross-sectional view of the furnacepyrolytic gasifier.

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiments illustrated. The preferred embodiment and configuration of the combined furnace-pyrolytic gasifier 10 is shown in FIG. 1. The furnace-gasifier 10 is utilized in the claimed process for pyrolytically producing a gas similar in molecular chemistry to natural gas, hereinafter referred to as synthetic gas, from either or both, virgin and/or selected segregated post-consumed paper and plastics, in the manner which will be later described herein.

Figure 3:
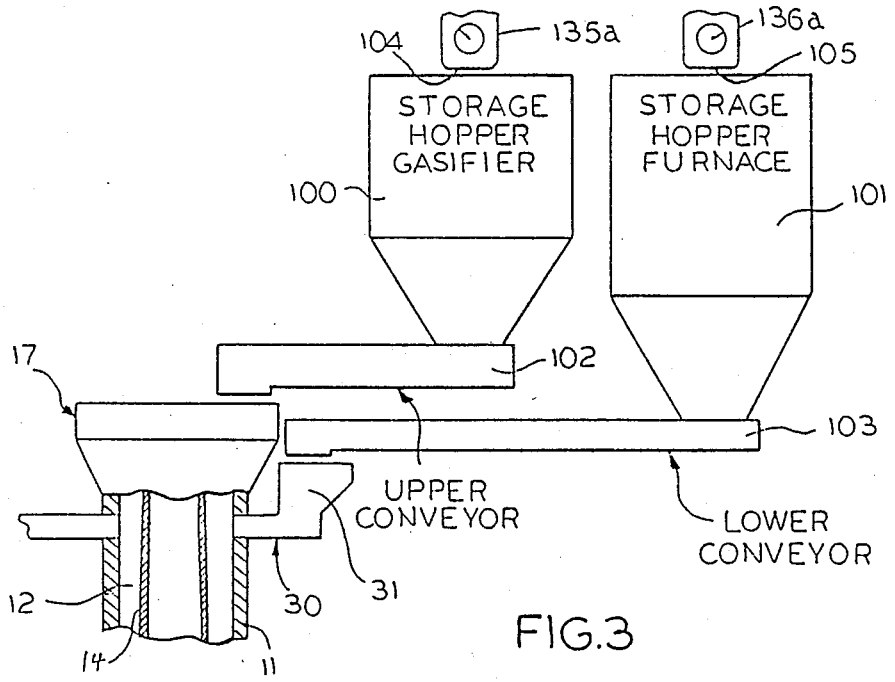
FIG. 3 is a partial side cross-sectional view of the feed hoppers and conveyors which deliver the gasifier fuel and the furnace fuel to the gasifier and furnace respectively.
Figure 5:
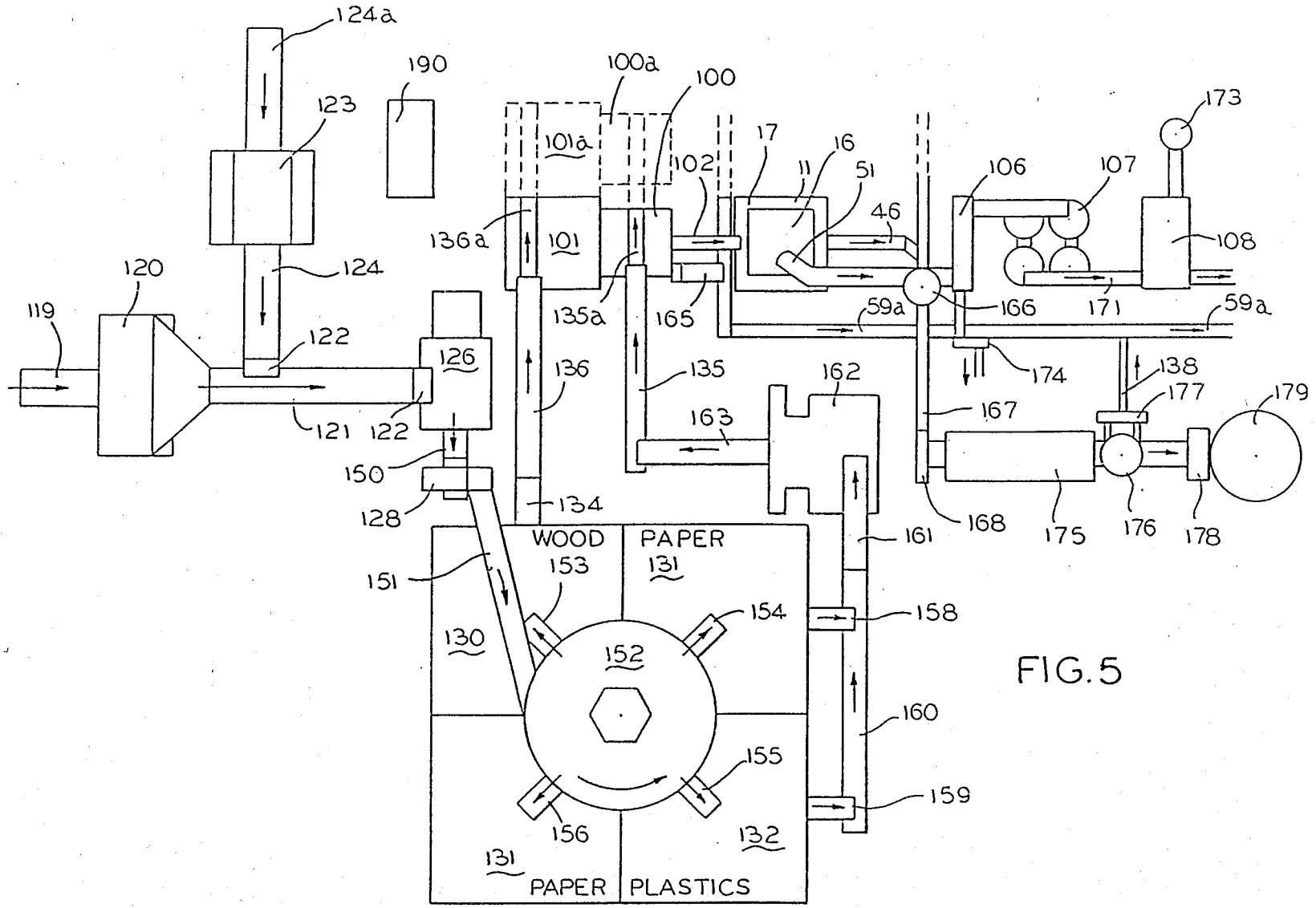
FIG. 5 is a flow diagram illustrating the various steps comprising the method and associated apparatus for pyrolytically producing synthetic gas.
Figure 7:
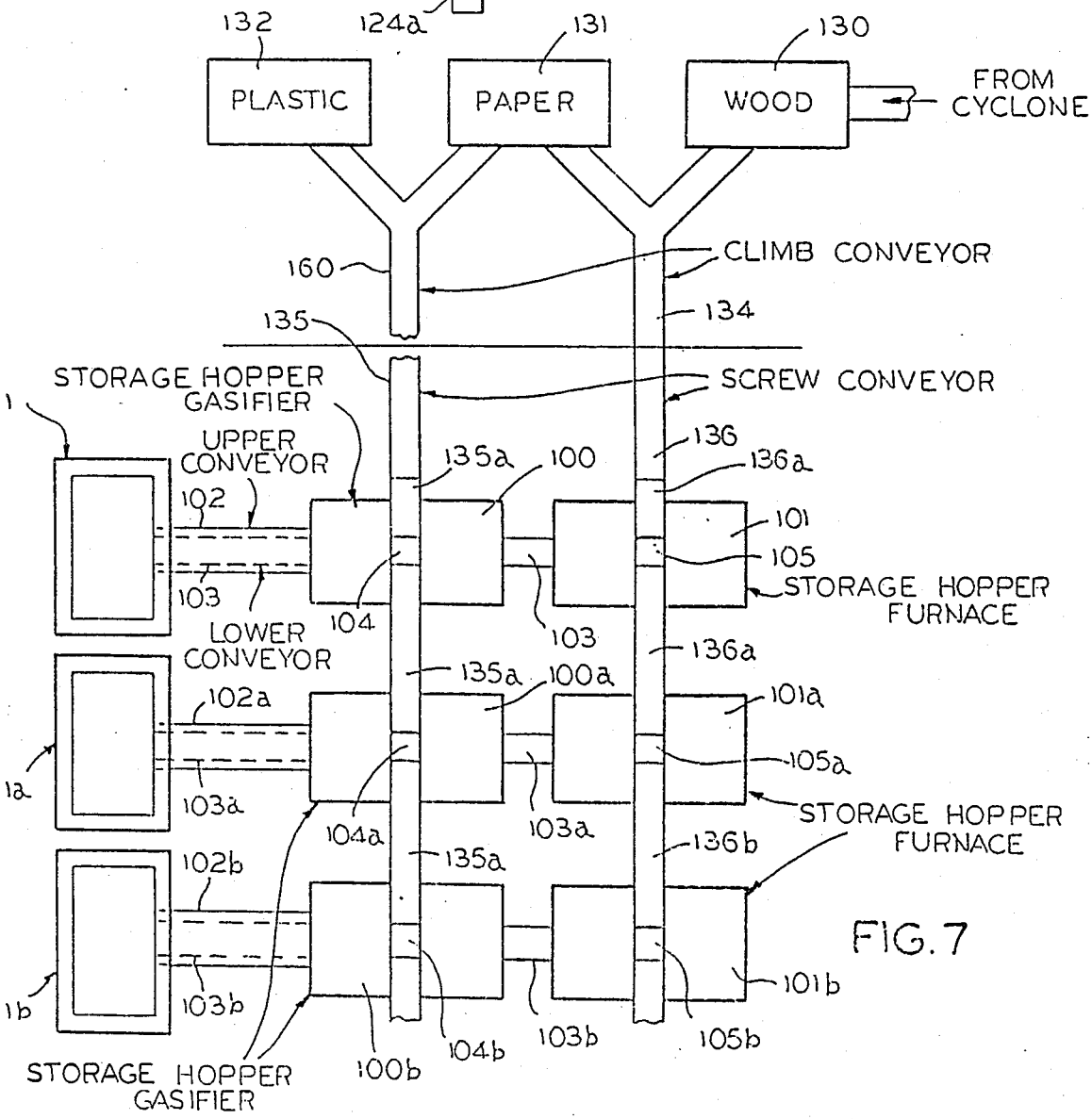
FIG. 7 is a schematic diagram illustrating how the various fuel components are transported from their respective hoppers to the gasifier feed hopper and furnace feed hoppers and ultimately to the furnace and the gasifier.

The preferred embodiment employs a furnace-gasifier 10 construction wherein the gasifier 14 is situated inside the furnace housing 11. The furnace fuel components are first presorted to remove all non-burnables, and then prepared in the manner to be described hereinbelow. Then, with respect to FIG. 1 and the furnace fuel feed means 30, the prepared furnace fuel mixture is deposited into the furnace fuel intake means and, in particular, furnace fuel feed hopper 31 from the storage hopper 101 (as shown in FIGS. 3, 5 and 7) by means of either an auger screw-type or flat belt type feed conveyor such as 103. In the case of the auger-type conveyors, such as 135*a* and 136*a*, referred to herein, they would be provided with an air cylinder activated, sliding bottom doors 104 and 105 for selective release of the materials carried therein, for vertical drop into storage hoppers 100 and 101.

The furnace fuel feed auger 32 positioned within furnace fuel feed conduit 44, having an upwardly exposed open portion 68, is driven by hydraulic motor 33 allowing the furnace fuel to be moved past the furnace fuel intake opening 43 and into the interior of the furnace housing 11 and into the firing area of the furnace chamber 12. Combustion air can be blown into the furnace chamber 12 under positive pressure, through combustion air intake means, and in particular, through an opening accommodating blower tube 52 by a combustion air blower, in order to insure proper combustion within the furnace chamber The volume of combustion air introduced into the furnace chamber 12 is regulated by a damper device (not shown) such as 49. An emissions gas analyzer (not shown) is used to control the operation of the combustion air blower and damper. Blower tube 52 is further provided with a movable cover enabling insertion of an ignition device (not shown) in the form of an acetylene torch, or the like, for initial ignition of the furnace fuel material.

The furnace liner 13 is made of a refractory material and is shaped in a substantially cylindrical configuration so as to cause both the introduced combustion air and subsequent firing of the furnace fuel, to be in a substantially upwardly spiraling or cyclonic pattern around the outside periphery of gasifier 14. Such cyclonic air flow within the furnace chamber 12 serves to effectuate substantially even heating of the gasification chamber 16, which it surrounds. Moreover, furnace exhaust opening 45 is provided near the top of the furnace housing 11, so as to require that the heat from combustion within the furnace chamber 12 travel around the gasification chamber a maximum number of times, so as to maximize the heating effect on the gasification chamber 16 prior to exiting the furnace housing 11 at furnace exhaust opening 45. The cyclonic or upwardly spiraling air flow pattern created within the furnace chamber 12 from air blower tube 52 at the bottom thereof to exhaust tube 46 at the top, also allows suspension firing of the furnace fuel, so that substantially complete combustion of such fuel materials has occurred prior to the depositing of the spent fuel ash on grate 69 at the bottom of the furnace housing 11.

Exhaust tube 46 is aligned with furnace exhaust opening 45 so as to enable communication with the interior of furnace chamber 12 in order to permit the furnace fuel exhaust gasses to exit the furnace chamber 12 through exhaust tube 46. The flow of such exhaust gasses is regulated by damper device 49 comprising damper blade 47 and screw handle 48, which serve to selectively increase or decrease the flow of furnace exhaust gas through exhaust tube 46. Damper blade 47 can be raised so as to open, or lowered so as to close or restrict, the flow of furnace exhaust through the exhaust tube 46, and is accomplished by turning the screw handle 48 in a rotary direction which in turn actuates the shaft 48*b* so as to raise or lower the damper blade 47. When the desired position is obtained, lock nut 48*a* is used to maintain the position. This process of restricting the free flow of exhaust gas is used to accomplish optimum excess combustion air ratios and the maximum absorption of the furnace heat by the gasifier 14. In the preferred embodiment, damper device 49 is identical in construction to the damper device used with respect to blower tube 52. Damper device 49 is also controlled by the emissions gas analyzer (not shown) which continually monitors the exhaust gas produced along exhaust tube 46 and adjusts the combustion air blower and damper as well as the exhaust damper device 49, accordingly.

The preferred embodiment further provides for solid or ash removal means including a multiple blade grate wiper 53 which rotates upon the top surface of the grate 69 so as to clear the top surface of the grate 69 and force the spent furnace fuel ash through the radial openings formed therein. This rotary motion of the multiple blade grate wiper 53 is accomplished through a connecting shaft to ring gear 54 engaging pinion gear 55, in turn rotated by drive shaft 56 driven by hydraulic motor 57. Coupling device 57*a* is interposed between motor 57 and drive shaft 56, and is of the type interposed between each of the hydraulic motors and draft shafts mentioned herein. As the spent fuel ash drops to the bottom of furnace chamber 12 and passes through grate 69, it then falls into the screw or auger conveyor 59 of the solid removal means, through the open top thereof, and is carried from the bottom of the furnace housing 11 by the inclined auger conveyor 28 which is driven by hydraulic motor 58. The spent fuel ash exits screw auger conveyer 59 through drop tube 60 for transport to and disposal at a remote location. Such spent fuel ash can also be stored for sale.

A central control console, not shown, exhibits a readout of the internal temperature within the furnace chamber 12 by means of thermocouple 71, having one end within the interior of the furnace chamber 12 and a second end on the exterior thereof. A second thermocouple 70 is also connected to the central control console, so as to similarly monitor the temperature inside the gasification chamber 16. These thermocouples are used to control the rate at which furnace fuel is fed by the furnace fuel feed means.

As explained above, in the furnace housing 11, exhaust gasses produced from the combustion of the furnace fuel, exit furnace chamber 12 through furnace exhaust opening 45 leading to exhaust tube 46. In order to maximize absorption of the heat produced within the furnace chamber 12 surrounding the gasification chamber 16, the combustion air entering the furnace chamber 12 through blower tube 52 is at slightly greater than atmospheric pressure, while the exhaust gasses exiting the furnace chamber 12 and furnace exhaust opening 45 are at less than atmospheric pressure.

Though the preferred embodiment employs the foregoing furnace configuration, an alternative embodiment could employ a solar powered furnace or such furnace means as may be fired by petroleum fuels to heat the gasifier 14.

Figure 2:
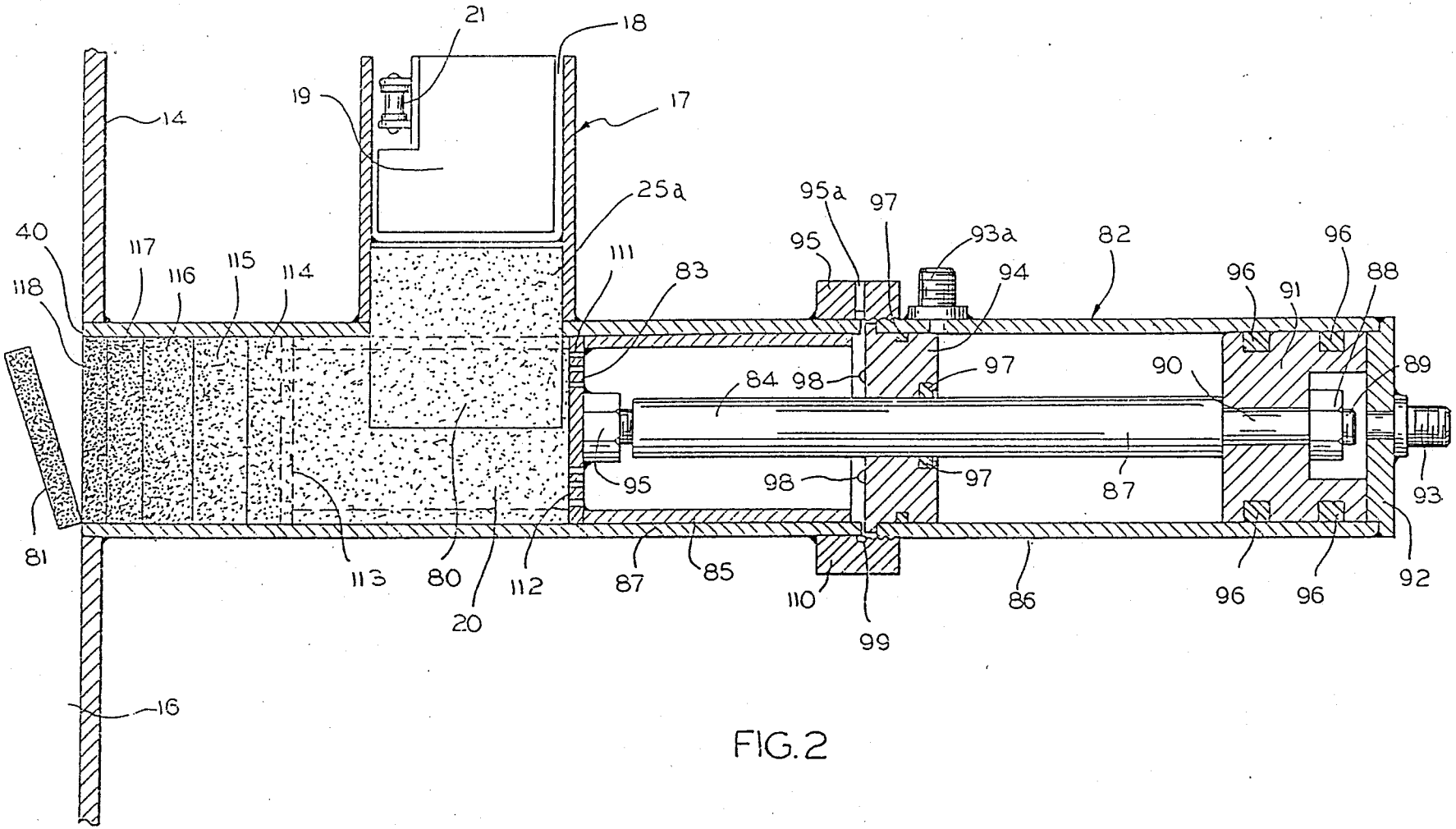
FIG. 2 is a side cross-sectional view of the gasifier fuel tray and hydraulic ram assembly for feeding the gasifier fuel into the interior of the gasifier.

FIG. 2 illustrates the manner in which the gasifier fuel is densified and injected into the gasification chamber 16, in the preferred embodiment. Pyrolytic gasification requires a virtually oxygen free atmosphere so as to avoid combustion and destructive detonation within the gasification chamber 16. Hence, the following method of compacting and injecting the gasifier fuel so as to remove the vast majority of entrapped oxygen, and obtain as low as 1% by volume of entrapped oxygen, is employed in the preferred embodiment.

With respect to the gasifier housing 14, as shown in FIGS. 1 and 2, the prepared pulverized gasifier fuel formula mixture is conveyed, into gasifier fuel hopper top 18*a* by means of either an auger type or flat belt type conveyor such as 102 and falls by gravity into the hollow upper chamber 18 of circumferential gasifier fuel feed tray means 17. Continuous roller chain 21 extends around the inner periphery of the hollow upper chamber 18 of gasifier fuel feed tray means 17. As illustrated in FIG. 1, continuous roller chain 21 is driven by sprocket gears 22, which are in turn driven by hydraulic motor 24 and primary sprocket gear 25 attached thereto. Paddles 19 are moved along the interior of hollow upper chamber 18 by continuous roller chain 21 to which they are attached, so as to continuously move the gasifier fuel around the interior channel of the fuel feed tray means 17 in a substantially even flow pattern. The roller chain 21 is guided by secondary sprocket gears 22 and driven by primary sprocket gear 25, which are located at each corner of the gasifier fuel feed tray means 17. The sprocket gears 22 are each supported by vertical shafts 23 which are each housed in upper and lower bearings 26. Coupling 27*a* is interposed between the drive shaft 27 and primary sprocket gear 25 and the hydraulic motor 24. Bearings 26 also surround drive shaft 27 and enable it to rotate therein.

In the preferred embodiment, the sprocket gears 22 connected by the roller chain 21, require only one drive shaft 27 coupled to the hydraulic motor 24, primary sprocket gear 25 and coupling 27*a*, in order to move the paddles 19, which stretch substantially across the width thereof, along the interior channel of gasifier fuel feed tray means 17. As the gasifier fuel is moved along hollow upper chamber 18 of gasifier fuel feed tray means 17 by paddle means 19, the fuel mixture drops by gravity through substantially vertical chutes or passages 25*a* (shown in FIG. 2) positioned along the bottom of the interior channel of upper chamber 18 into hollow fuel tray lower densification chamber 20. The lower tray chamber 20 has one or more lower compaction areas. As seen in FIG. 2, one or more hydraulic ram assemblies 82 are aligned with the gasifier fuel intake means, comprising fuel feed ports 40, as shown in FIGS. 1 and 2, positioned about the compaction areas of lower fuel tray densification chamber 20, which communicate with the interior of gasifier chamber 16.

The preferred embodiment of the present invention employs a configuration of four substantially orthogonally positioned hydraulic ram assemblies 82, each aligned with corresponding fuel feed ports 40 about the periphery of the top outer portion of gasifier 14, though other configurations and numbers of hydraulic ram assemblies are possible. As will be described in greater detail hereinafter with respect to FIG. 2, extension of platen 83 by piston rod 84 serves to compress and inject gassifier fuel mixture 80 present in lower densification chamber 20, through fuel feed port 40 and into gasification chamber interior 16.

Within the interior of the gasification chamber 16 is gasifier mixing means comprising rotary shaft 36 having several mixing impeller paddles 37 mounted thereon by means of locking collars 39. The rotary shaft 36 penetrates the interior of the gassifier 14 through a compressive stuffing box 42 and is connected to hydraulic motor 41 by coupling 41*a*. In the preferred embodiment, the impeller paddles are rotated at approximately 20 r.p.m.

This gasification chamber mixing means 35 performs several functions. Firstly, it mixes the compacted or densified disks 81 of gasifier fuel mixture produced by the hydraulic ram assemblies 82 of the gasifier fuel feed means illustrated in FIG. 2 and further serves to move the gasifier fuel towards the outer periphery of the gasification chamber 16—the hottest portion thereof, so as to hasten the gasification process. Moreover, the gasification chamber mixing means 35 also serves to mix the newly injected gasifier fuel wafers or densified disks 81 with the gasifier fuel char previously produced during the process, so as to further hasten the gasification process from solid fuel mixture to synthetic gas and char.

In the preferred embodiment, gasifier 14 is substantially cylindrical in shape and has a substantially cone-shaped bottom portion 66, which narrows in the downward direction, as well as fuel char removal means associated therewith. Collar 65 which allows rotary shaft 36 to pass therethrough and rotate therein, is provided with openings 65*a* in order to enable spent gasifier fuel in the form of char, to pass therethrough and out the lower open end 66a of gasifier cone-shaped bottom portion 66 into sleeve 63. The gasifier char is removed from the furnace housing 11 by the solid removal means and char removal means including, sleeve 63 which communicates with and receives the gasifier char from opening 66a. Hydraulic cylinder ram 64, (having substantially the same operation and construction as hydraulic ram assembly 82,) when selectively extended, serves to clear sleeve 63 by pushing the char through char removal tube or conduit 62, elbow pipe 61 and eventually into the open top of auger conveyor 59 for conveyance through drop tube 60. A one way valve 62a, such as a flap valve, is provided as air sealing means in the interior of elbow pipe 61 of char removal tube or conduit 62, so as to prevent the undesired seepage of air into the interior of gasification chamber 16, since it is biased to close off elbow pipe 61 when char is not being pushed through char removal tube 62 by hydraulic cylinder ram 64.

The synthetic gas formed by the pyrolytic gasifier 14 exits from the gasification chamber 16 through escape means opening 50 communicating with exhaust pipe 51. As will be described in greater detail in connection with FIGS. 4 and 6, the synthetic gas produced is pumped to the filtration system and stored in collection means.

FIG. 2 shows platten 83 in its initial, retracted position 112. After the formulated gasifier fuel mixture 80 fills densification chamber 20, the hydraulic system controls cause pressurized hydraulic fluid to enter fitting 93 and unpressurized fluid to exit fitting 93a. This imbalance causes piston 91 which is sealed against leakage by seals 96 to move forward within hydraulic cylinder 86. This movement is transmitted to the platten 83 by the piston rod 84, as shown in phantom by fully extended position 113. In the preferred embodiment, the connection and point of adjustment of the piston rod 84 to the platten 83 is a hexagonal nut 95 welded to the back side of the platten 83. An alignment closure skirt 85 is also welded to the platten 83 which closes off the chute 25a as the platten 83 moves to its forwardmost or extended position 113. Since the radial clearance between closure skirt 85 and housing 87 is maintained within close tolerances, vent holes 111 are drilled in the platten so that the air released by compacting and densifying the gasifier fuel mixture 80 can escape and pass through platten 83 to the void created by the platten 83 moving to the extended position 113 (shown in phantom).

Due to the coefficient of friction of the gasifier fuel feed mixture 80 against the circumferential interior of housing 87 and the continuous stroking of the platten 83 each time picking up additional gasifier fuel mixture 80 from the densification chamber 20, densified disks 81 having a minimum unit density of 60 lb/ft$^3$ of gasifier fuel mixture 80 (whose unit density at this point is 10–15 lb/ft$^3$) are formed under high pressure and eventually are extruded into the inside of the pyrolytic gasification chamber 16 through feed ports 40. In the preferred embodiment, feed ports 40 are substantially circular, though other shapes, such as oval, square, or triangular are possible. Fuel mixture portions 114, 115, 116, 117 and 118 denote the various stages of densification of gasifier fuel mixture 80 corresponding to strokes by platten 83, prior to extrusion, in turn, of each fuel mixture portion pressed into gasification chamber 16 as densified disks or wafers 81. The aforementioned coefficient of friction effect alone, serves to resist the tendency of platten 83 to merely push gasifier fuel mixture 80 into gasification chamber 16. With the stroking of the platten 83, gasifier fuel mixture 80 is increasingly compacted or densified, in the direction of the feed ports 40, densified disks 81 independently drop into gasification chamber 16. By thus removing the major portion of the atmospheric oxygen and nitrogen present within the gasifier fuel feed stock by the aforementioned dense compaction operation, the possibility of disastrous combustion and subsequent detonation are substantially eliminated within the sealed gasification chamber 16. In addition, a higher heat value synthetic gas is produced, due to the removal of the oxygen and nitrogen, both of which are nonheat producing gases. In addition, this densification also allows the vacuum removal of the synthetic gasses produced when the gasifier fuel feed mixture is heated to the gasification temperature required for conversion of the densified gasifier fuel to synthetic gas.

In order to retract platten 83, hydraulic fluid pressure is exerted at fitting 93a through a switching valve which opens hydraulic fitting 93 to a hydraulic fluid reservoir (not shown), thereby forcing the piston 91 which is connected to the piston rod 84 by hex nut 88, to move to the rear of the hydraulic cylinder 86 and eventually into the retracted position 112. Gland 94 acts as a guide for the piston rod 84, while seal 97 seals the hydraulic fluid from leaking. The bonnet nut 110 is welded to the housing 87 and is threaded internally at 99. Hydraulic cylinder 86 is screwed into bonnet nut 110 so as to maintain the gland 94 between the housing 87 and the hydraulic cylinder 86.

As the platten 83 reaches its extended position 113, the alignment closure skirt 85 seals off the vertical chute 25a, thereby preventing fuel from falling in back of the platten 83. When the platten 83 returns to its retracted position 112, the atmospheric air entrapped in the area behind platten 83 is exhausted by passing first through the air release vent holes 111, then through vent holes 98 and eventually exiting at vent 95a. Alternative venting means are also possible.

The aforementioned hydraulic ram assemblies are each positioned in outwardly extending housings 87 formed on the outside of gasifier fuel feed tray means 17. The housings 87 are aligned with fuel feed ports 40, and in turn the lower compaction area, so as to enable the lower chamber 20 to communicate with the interior of gasifier chamber 16. The gasifier fuel mixture has a density of approximately 1 lb./ft.$^3$ to 50 lb./ft.$^3$ before compaction and approximately 60 to 90 lb./ft.$^3$ thereafter.

Gasifier fuel mixture 80 is fed to the gasifier feed storage hopper 100 by screw conveyor 135a which has affixed thereto an air cylinder operated sliding bottom door 104 which is selectively opened in order to fill the gasifier feed storage hopper. The furnace feed hopper 101 is similarly fed by screw conveyor 136a and bottom sliding door 105. FIG. 3 shows gasifier feed storage hopper 100 which continually supplies gasifier fuel mixture 80 to gasifier fuel feed tray means 17 through upper screw or flat belt conveyor 102 which in turn, deposits the gasifier fuel mixture 80 into the fuel hopper top 18a thereof (shown in FIG. 1). Also shown in FIG. 3 is furnace feed storage hopper 101 which continually releases furnace fuel to lower screw or flat belt conveyor 103 which in turn deposits the furnace fuel mixture into furnace fuel feed hopper 31 of furnace fuel feed means 30 and in turn to auger 32 which serves to transport the furnace fuel into the furnace chamber 12 of furnace housing 11, through furnace fuel intake opening 43.

Figure 4:
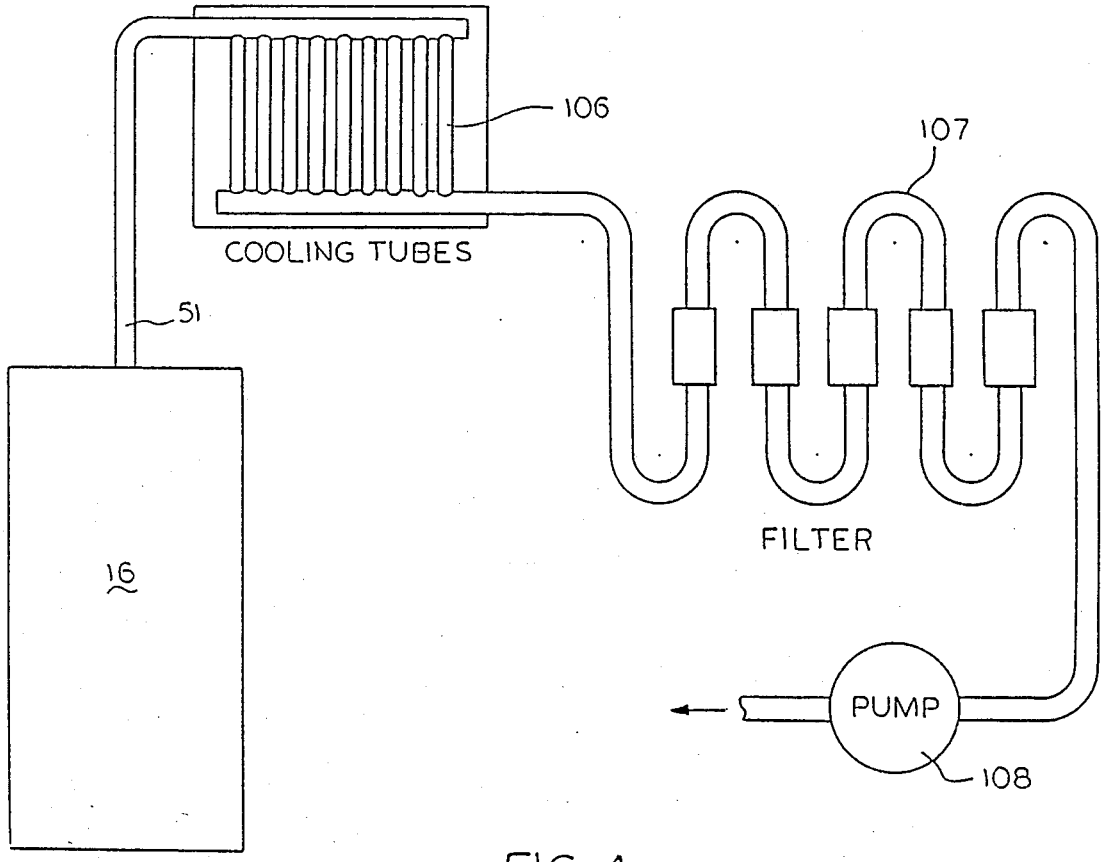
FIG. 4 is a schematic diagram of the cooling, filtering, and pumping operations performed on the synthetic gas produced within the furnace-gasifier.

FIG. 4 schematically illustrates gasification chamber 16 from which suction pump 108 withdraws the synthetic gas produced through the pyrolytic gasification process, through exhaust tube or pipe 51 before passing through cooling tubes 106 and filtering means 107. The gas collection process shown in FIG. 4 will be described in greater detail herein with respect to FIG. 5.

Figure 6:
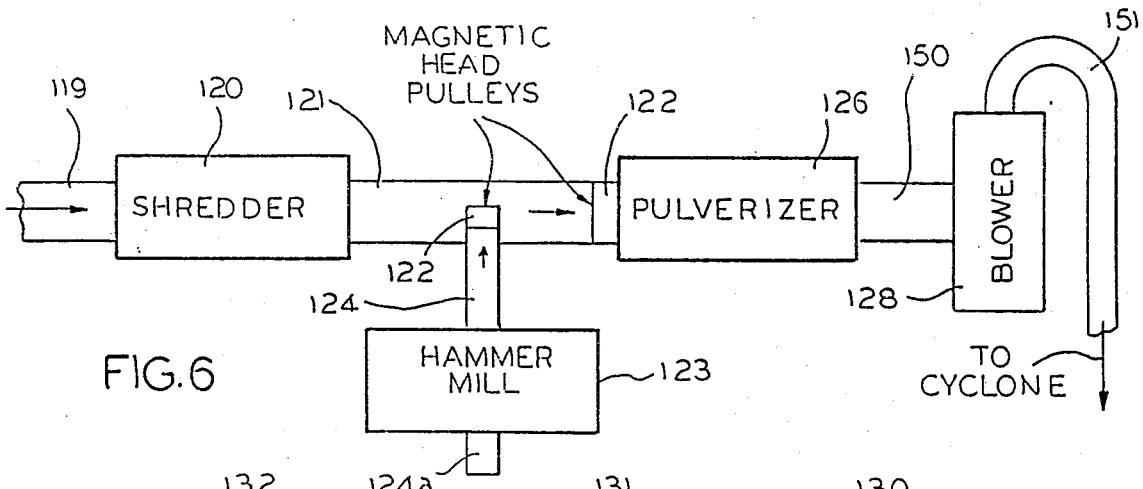
FIG. 6 is a flow diagram of the various steps which comprise the preparation of the furnace and gasifier fuel's components.

FIG. 5 is a flow diagram for the various steps and operations comprising the preferred embodiment of the overall process for pyrolytic gasification. The preparation of the furnace fuel mixture and the gasifier fuel mixture, is shown in FIGS. 6 and 7. In the preferred embodiment conveyor 119 is a flat belt conveyor which is utilized to feed light unit density materials of less than 30 lb/ft$^3$ such as a combination of paper products, plastic sheeting and plastic containers or various other light unit density materials into the input side of fixed blade shredder 120. The blades of shredder 120 rotate at high speed so as to shred the raw materials delivered by conveyor 119 into a mass of substantially non-uniform consistency comprising pieces of material having a size of 4" minus (pursuant to the definition of the U.S. Code of Standards which is defined as 80% of that material passing through a U.S. mesh screen having openings of that size.) These shredded materials, upon exiting shredder 120 at the output side thereof, are then deposited onto conveyor 121 which is a flat belt conveyor equipped with a magnetic head pulley 122 for magnetic pre-sorting of the material by removing nails, staples, iron pieces and other ferrous metal objects present in the shredded materials.

As further shown in FIGS. 5 and 6, high density materials such as a combination of wooden planks, wooden cases, wooden pallets, tree trimmings, plastic cases, plastic moldings or plastic pallets or various other high unit density materials are instead deposited on flat belt fixed speed conveyor 124*a* which carries the high density materials to the input side of hammermill 123, which in the preferred embodiment is a fixed blade hammer-type hammermill which will reduce the materials passing therethrough to pieces having a size of approximately 4" minus. As the milled materials are cut to size within the hammermill 123 and exit the output side thereof, they are then deposited onto conveyor 124 which is also a flat belt fixed speed conveyor which likewise has a magnetic head pulley 122 for magnetic pre-sorting of the materials at one end which removes undesired magnetic ferrous metal objects such as nails, staples and scrap iron from the high density materials. Magnetic head pulleys 122 are arranged so as to remove and dump the undesired metallic objects into appropriate waste containers. The prepared materials from conveyor 124 are then deposited onto conveyor 121 and are then fed to the input side of pulverizer 126, which uses multiple swinging blades attached to a main shaft rotating at high speed within a perforated steel plate screen, to pulverize the materials passing therethrough to a size of no greater than $\frac{3}{8}$" minus. In some instances the flat belt conveyor 124 may be set to feed onto flat belt conveyor 119 thereby feeding fuel materials through shredder 120 then onto flat belt conveyor 121 and in turn, to pulverizer 126.

Screw conveyor 150 serves to move the pulverized material from the output side of pulverizer 126 to the material segregation means which includes non-clogging blower 128 which in turn propels material through pipe 151 to the cyclone centrifuge 152. The aforementioned steps can be performed on one type of material at a time, or simultaneously on more than one type.

The cyclone centrifuge 152 separates the pulverized material from the air and allows the particles to settle to the distribution chutes 153, 154, 155 and 156 which lead to one of the four storage hoppers 130, 131, and 132, which, in the preferred embodiment, store wood products, paper products and plastic products, respectively. Control means (not shown) enable selective operation of certain of the above-described components so as to replenish a particular material storage hopper. For instance, in order to replenish a dwindling paper products hopper 131, the following would be activated: conveyor 119; shredder 120; conveyor 121; pulverizer 126; screw conveyor 150; blower 128; pipe 151; cyclone 152; and distribution chutes 154 or 156.

In order to replenish a dwindling wood products hopper 132 the following would instead be activated: conveyor 124*a*; hammermill 123; conveyor 124; conveyor 121; pulverizer 126; screw conveyor 150; blower 128; pipe 151; cyclone 152 and chute 153 leading into wood storage hopper 130. To replenish the plastic hoppers 132 when both plastic cases and plastic sheet are to be run, the following components would be activated: conveyor 119; shredder 120; conveyor 124*a*; hammermill 123; conveyor 124; conveyor 121; pulverizer 126; screw conveyor 150; blower 128; pipe 151; cyclone 152; and distribution chute 155 leading into plastic storage hopper 132. In the preferred embodiment, storage hoppers 130 and 131 store the wood and paper furnace fuel components, while storage hoppers 131 and 132 store the gasifier fuel components of paper and plastics.

Fuel component mixing means includes proportioning meter boxes or scale weighing pans (not shown) attached to the bottom of the hoppers 130, 131 and 132 for automatically mixing the proper proportions of each material with respect to both the furnace fuel components storage hoppers 130 and 131 as well as the gasifier fuel components storage hoppers 131 and 132. With respect to the furnace fuel component, the proportioning meter boxes or scale weighing pans deposit the proper weights of each material from hoppers 130 and 131 into mixing screw feed conveyor 134, which deposits the mixed furnace fuel components into a bucket elevator conveyor 136 for deposit into the furnace feed hopper 101.

The proportioning formulation of the gasifier fuel components (plastic and paper) from the hoppers 131 and 132 is accomplished with proportioning meter boxes or scale weighing pans (not shown) releasing the proper pre-selected weights of plastic and paper from hoppers 131 and 132 onto flat belt conveyors 158 and 159 and then into mixing screw feed conveyor 160 which thoroughly mixes the two material components of the gasifier fuel together. Screw conveyor 160 then deposits the gasifier fuel material into climb conveyor 161 having lugs attached to it to lift the material without it sliding back down the conveyor belt. The gasifier fuel material can then be deposited into an optional pelletizer 162 which compresses the gasifier fuel into small, dense pellets which are ejected onto conveyor 163 and then in turn deposited onto conveying means such as a bucket elevator conveyor 135, for deposit into gasifier feed hopper 100. However, the use of such pelletized gasifier fuel can result in the gasifier fuel mixture having an increased amount of undesired entrapped nitrogen and oxygen.

As described in connection with FIG. 3, upper conveyor 102 carries the gasifier fuel mixture 80 to the gassifier feed tray means 17 while lower conveyor 103 (not shown in FIG. 5) carries the furnace fuel from furnace feed hopper 101 to furnace fuel feed means 30. More specifically, in the preferred embodiment, the furnace chamber 12 and gasification chamber 16 are fed as follows. With respect to the gasifier chamber, as shown in FIG. 7, the gasifier fuel mixture 80 comprising the prepared plastic and paper materials from storage hoppers 132 and 131 passes first on flat belt conveyors 158 and 159, then into screw conveyor 160, and then onto climb conveyor 161 which deposits the gasifier fuel mixture into pelletizer 162, onto conveyor 163, into bucket elevator conveyor 135, then into overhead screw conveyor **135*a* and through sliding door 104 so as to fall by gravity into gasifier feed hopper 100**.

Similarly, with respect to the furnace chamber 12, as shown in FIGS. 5 and 7, the furnace fuel mixture, comprising the prepared paper and wood products from storage hoppers 130 and 131, is carried first by screw conveyor 134 and then deposited by climb conveyor 136 onto overhead screw conveyor **136*a* through sliding door 105 and falling by gravity into furnace feed hopper 101. Upper conveyor 102 transports the gasifier fuel mixture 80 from feed hopper 100 to gasifier fuel feed means 17, while lower conveyor 103 transports the furnace fuel mixture from feed hopper 101 to furnace fuel feed means 30, in the manner previously described in FIG. 3**.

As further shown in FIG. 7, several furnace-gasifiers **11*a* and 11*b* can also be employed with corresponding gasifier feed hoppers 100*a* and 100*b*; furnace feed hoppers 101*a* and 101*b*; conveyors 102*a*, 102*b*, 103*a* and 103*b*; and various combinations of screw conveyors designated as 135*a* and 136*a* which link the various feed hoppers, so as to enable selective filling or release of material therefrom. Control means (not shown) enable selective filling of feed hoppers 100, 100*a*, 100*b*, 101, 101*a*, and 101*b* etc. from material hoppers 130, 131 and 132**.

Electrically driven hydraulic control system shown at 165 supplies fluid to the drive components such as the hydraulic motors such as 24, 33, 41, 57 and 58 and piston actuators 64 and 82 of the system. Likewise, the preferred embodiment employs a control system to selectively activate the various conveyors and hoppers, as well. In addition, gas chromatograph equipment is also provided at control housing 190 for analyzing the gas produced.

Ash conveyor 59, as previously described, is a screw-type or auger conveyor that transports the ash from the furnace and char from the gasifier to a refuse container (not shown), or to storage for sale.

Furnace housing 11 is shown in FIG. 5 as having furnace exhaust tube 46 attached to the side thereof and allowing the furnace exhaust from the furnace 11 to be drawn out by induction blower 168 so as to pass to the bag house 175 which removes virtually all of the particulate matter from the exhaust, by passing the gas through fabric panels. Recirculating pump and settling tank 177 circulates water through the wet precipitator 176 so as to clean and cool the exhaust prior to its being released into the environment through the exhaust stack 179 by stack blower 178 and into the atmosphere. Sludge from the wet precipitator 176 settling tank is propelled to the ash conveyor 59 by a small auger conveyor 138.

The synthetic gas produced in the gasifier 14 is removed in the following manner. The synthetic gas produced rises and exits the gasifier chamber 16 through pipe 51 and is moved through particulate removal means which is a precipitator 166 or the like which settles out particulates from the synthetic gas stream. The synthetic gas then enters the top of the synthetic gas cooler 106. During the cooling of the synthetic gas, liquid hydrocarbons form as droplets within the cooler and float to the bottom thereof, where they are removed and pumped by hydraulically powered suction pump 174 to a storage tank (not shown).

These liquid hydrocarbons typically, in the preferred embodiment, take the form of a petroleum distillate have a heat value range in the $C_{11}$ to $C_{13}$ range, and can be used as a liquid fuel. Tests have shown that approximately one quart of liquid hydrocarbons can be produced per 10 lbs. of gasifier fuel used. Independent tests have also shown that based on gas chromatography, the liquid hydrocarbons are in the aforementioned $C_{11}$ to $C_{13}$ range and have a boiling point in the range of 120° C. to 130° C. and a heat content of approximately 960 BTU/lb.

The synthetic gas is then drawn through secondary filtration system 107, which in the preferred embodiment is a dual filtration system, enabling either one set of the triple element industrial media filters or the other to operate to clean the synthetic gas produced, and thereby enable changing of the filters not in use, without interruption in the process, so as to remove particulates and liquids up to approximately a 10 micron final filtration level. Synthetic gas pumping system 108, which is a suction pump then draws out the gas under slight negative pressure and compresses it into a storage holding tank prior to use thereof. Flare pipe 173 enables the burning off of excess gas production or in an emergency situation. In the preferred embodiment, a gas chromatograph is used to continually monitor the gas produced and record the various constituents thereof and their combined heat values.

The heat produced during combustion can be utilized in a heat exchanger for production of steam or heated air. Also, an absorption chiller can be used to produce cooled air.

The following are the optimum formulations for the previously described gasifier fuel mixture 80 of the preferred embodiment. Varying the proportions of paper and plastic products results in differing volumetric yields of gasses, having differing fuel quantities. Formula No. 1, for instance, employs a range of 1% to 25% by weight of plastic products and a corresponding range of 99% to 75% by weight of paper products. The synthetic gas produced has a low BTU output.

Formula No. 2 uses a range of 26% to 50% by weight of plastic and a corresponding range of 74% to 50% by remaining weight of paper, and produces a middle range BTU synthetic gas product. Increasing the amount of plastic to 51% to 99% by weight and decreasing the corresponding paper content to 49% to 1% by remaining weight produces a high BTU output synthetic gas in Formula No. 3.

Similarly, employing only plastics as the gasifier fuel in Formula No. 4 results in the production of very high BTU synthetic gas. Likewise, other additives can be added to the foregoing paper and plastic gasifier fuel components.

In addition, the synthetic gas produced in the abovedescribed process is regulated as to volumetric rate, BTU value and constituent composition by selectively varying the gasification chamber temperature within the range of approximately 700° to 950° F. and the rate at which the gasifier fuel is fed, at anywhere from approximately 25 lbs./hour to 100 tons/hour. The synthetic gas produced by the present invention can range, depending upon the gasifier feed mixture formula, from a low of approximately 900 BTU/ft.$^3$ to well over approximately 2000 BTU/ft.$^3$.

More specifically, the particular pyrolytic gasifier fuel formulations used in the present invention are comprised of selected and segregated post-consumer materials strictly comprised of only the following types of materials: (a) high density and low density polyethylene; (b) polypropylene; and/or (c) paper products consisting of boxboard, chipboard, newsprint, corrugated, white or colored ledger, bond or computer stocks. The average heat value for materials (a) and (b) is approximately 19,000 BTU/lb, while that for material (c) is approximately 8100 BTU/lb. when the moisture content is below 5%. No other plastics or paper products are used in the pyrolytic gasifier fuel feedstock formulations.

The following three fuel formulas were pyrolytically gasified in the disclosed invention for periods of not less than four hours of continuous fuel feeding, synthetic gas production and char and ash removal to produce the following heat values, efficiency values and flame temperatures: T,0340

Gaseous heat value is defined as the Resultant Gas Heat Value multiplied by the Total ft$^3$/lb input produced. Gasifier efficiency is defined as the Gaseous Heat Value divided by the Combined Heat Value. The particular compositions of the synthetic gas obtained from the foregoing gasification operation for each formulation are as follows: T,0350 T,0360

In continuous operation, following the foregoing parameters, the following results were realized. The maximum furnace/gasifier operating temperature of 1750 degrees Farenheit can be reached in 15 minutes after start-up. The minimum furnace fuel feed rate to maintain this temperature was found to be ½ lb/minute. If furnace fuel was fed at a greater rate without the gasification process operating, the furnace temperature would increase to unacceptably high levels. The furnace fuel feed rates were increased in proportion to the gasifier fuel feed rates. The amount of combustion air within the furnace and the exhaust relief by way of a damper, were controlled by an emissions gas analyzer Also, the rate of synthetic production rate was restricted by the capacity of the synthetic gas suction pump.

In addition, the following non-aspirated flame temperatures (comprising an average temperature over 4 hours of operation obtained for each fuel formulation which was tested) were obtained: 80 degrees Farenheit for Formula I; 1250 degrees Farenheit for Formula II; and 1625 degrees Farenheit for Formula III. The following temperatures were also obtained for comparison purposes for the following gases using the same testing equipment: 1020 degrees Farenheit for natural gas; 1180 degrees Farenheit for bottled propane; and 1220 degrees Farenheit for bottled butane.

The foregoing description and drawings merely explain and illustrate the invention and the invention is not limited thereto, except insofar as the appended claims are so limited, as those skilled in the art having the disclosure before them will be able to make modifications and variations therein without departing from the scope of the invention.

What is claimed is:

1. A method for the pyrolytic production of synthetic gas from components of solid, light unit density materials of less than 30 lb/ft$^3$ and high unit density materials of more than 30 lb/ft$^3$, including selected segregated postconsumed waste materials, within a pyrolytic gasifier operably heated by an associated furnace, said method comprising the steps of:

preparing said materials for use as pyrolytically decomposable gasifier fuel by physically fragmenting same through material preparation means;

conveying said materials from said material preparation means to material segregation means by material conveying means operably associated therebetween;

segregating said materials into separately and physically distinct homogenous ones of stored segregated components of said gasifier fuel by said material segregation means;

delivering from said material segregation means said components of gasifier fuel formulation into a desired gasifier fuel component ratio by gasifier fuel delivery means to compacting means, as a formulated gasifier fuel mixture;

compacting said gasifier fuel mixture by said compacting means operably connected to said gasifier fuel delivery means, so as to substantially eliminate entrapped oxygen and nitrogen within said gasifier fuel mixture and to prevent the potential for oxygenated combustion thereof;

heating the interior of said gasifier means by furnace means operably positioned adjacent said gasifier means for, in turn, heating said gasified fuel mixture to a desired temperature of between 700 degrees Fahrenheit and 900 degrees Fahrenheit;

transporting said gasifier fuel mixture from said compacting means to gasifier fed means by said material conveying means operably associated therewith;

feeding said desired ratio of densified gasifier fuel formula mixture into said gasifier means at a minimum unit density of 60 lb/ft$^3$;

directing said gasifier fuel mixture within said gasifier means towards the exterior periphery of said gasifier means to facilitate the formation of said synthetic gas through the pyrolytic decomposition of said gasifier fuel formula mixture therewith; and collecting said synthetic gas formed within said gasifier means by said pyrolytic decomposition of said gasifier fuel formula mixture by gas collection means operably associated with said gasifier means, said gas collection means channeling said gas component to gas collection means.

2. The invention according to claim 1 wherein said method further comprises the operation of:

preparing one or more of said materials by said material preparation means for simultaneous use as burnable furnace fuel;

mixing said components of furnace fuel into a preselected furnace fuel mixture by furnace fuel mixing means;

conveying said furnace fuel mixture from said mixing means to furnace feed means by said material conveying means;

feeding said furnace fuel mixture into said furnace means by said furnace feed means;

igniting said preselected furnace fuel mixture by ignition means so as to commence sustained combustion of said furnace fuel mixture within said furnace means; and burning said furnace fuel mixture within said furnace means so as to heat said furnace means to a desired temperature of between 1550 degrees Fahrenheit and 1750 degrees Fahrenheit thereby also converting at least some of said furnace mixture to ash and exhaust gasses, prior to the operation of feeding said gasifier mixture into said gasifier means.

3. The invention according to claim 2 wherein said method further comprises the operation of injecting air into said furnace means during ignition of said furnace fuel mixture, by combustion air blower means operably associated with said furnace means for substantially even combustion of said furnace fuel mixture within said interior of said furnace means.

4. The invention according to claim 2 wherein said method further comprises the operation of removing of said furnace ash from said furnace means by solid removal means operably associated with said furnace means.

5. The invention according to claim 2 wherein said method further comprises the operation of removing of said furnace fuel exhaust gasses from said furnace means through exhaust means operably associated therewith.

6. The invention according to claim wherein said method further comprises the operation of removing gasifier fuel char from said gasifier means by solid removal means operably associated with said gasifier means.

7. The invention according to claim 1 wherein said method further comprises the operation of cooling to ambient temperature said collected gas by gas cooling means operatively interposed between said gasifier means and said gas collection means.

8. The invention according to claim 1 wherein said method further comprises the operation of filtering said collected synthetic gas by synthetic gas filtering means operatively interposed between said gasifier means and said synthetic gas collection means.

9. The invention according to claim 1 wherein said method further comprises the operation of pumping said synthetic gas from said synthetic gas collection means by pump means operatively interposed therebetween.

10. The invention according to claim 1 wherein said method further comprises the operation of filtering said furnace exhaust gasses so as to trap and retain substantially all particulates present therewithin, by furnace exhaust gas filter means operatively associated with said gas exhaust means.

11. The invention according to claim 2 wherein said operation of preparing said materials includes the magnetic pre-sorting of said furnace fuel to remove all ferrous metal non-burnable materials therefrom.

12. The invention according to claim 2 wherein said operation of preparing said material comprises:

shredding said light unit density materials of less than 30 lb/ft$^3$ by shredder means;

grinding said high unit density materials of more than 30 lb/ft$^3$ by hammermill means; and conveying of said shredded light unit density materials and said ground high unit density materials to pulverizing means by said conveying means operably associated with said shredder means and said hammermill means.

13. The invention according to claim 12 wherein said material preparation means comprises:

shredder means operably associated with said conveying means so as to receive light unit density materials from said conveying means at an input side of said shredder means and to shred said light unit density materials within the interior of said shredder means prior to the exiting of said materials from said shredder means through an exit side thereof;

hammermill means operably associated with said conveying means so as to receive said high unit density materials from said conveying means at an input of said hammermill means and grind said high unit density materials within the interior of said hammermill means, prior to exiting said hammermill means through an exit side thereof;

pulverizer means operably associated with said conveying means so as to be capable of receiving a preselected combination of said shredded light unit density materials and said ground high unit density materials at an input side of said pulverizer means and pulverizing said materials within the interior of said pulverizer means prior to exiting said pulverizer means through an exit side thereof;

magnet means operably associated with one or more of said shredder means, hammermill means and pulverizer means for removing any ferrous metallic objects present in said materials; and control means operatively associated with said conveyor means, said shredder means and said hammermill means so as to enable selection of the amount of said shredded light unit density material and said ground high unit density material which reaches said pulverizer means.

14. The invention according to claim 13 wherein said shredder means comprises a fixed blade shredder capable of reducing said light unit density materials to a substantially non-uniform consistency of 4" minus in size.

15. The invention according to claim 1 wherein said light unit density materials comprise selected segregated post-consumed paper material formed of a combination of boxboard, chipboard, newsprint, corrugated, white or colored ledger, bond or computer paper; and light unit density selected segregated post-consumed plastic material formed of a combination of low density polyethylene and polypropylene.

16. The invention according to claim wherein said high unit density materials comprise material formed of a combination of high density polyethylene and polypropylene.

17. The invention according to claim 1 wherein said operation of directing said gasifier fuel mixture further comprises mixing into formulation of said mixture by gasifier mixing means.

18. The invention according to claim 13 wherein said pulverizer means is a pulverizer capable of reducing the size of said materials to particles of less than approximately $\frac{3}{8}$" minus in substantially non-uniform size.

19. The invention according to claim 13 wherein said hammermill means comprises a fixed blade type hammermill capable of reducing said high unit density materials to particles less than approximately 4" minus in substantially non-uniform size.

20. The invention according to claim 13 wherein said magnet means comprises:

a first magnetic head pulley operably associated with said conveying means proximate said hammermill means, and a second magnetic head pulley operably associated with said conveying means proximate said shredder means, so as to substantially remove and retain said ferrous metallic objects from said materials.

21. The invention according to claim 13 wherein said material conveying means comprises:

first conveyor means operably associated with said input side of said shredder means for conveying said light unit density materials into said input side of said shredder means;

second conveyor means operably associated with said hammermill means for conveying said high unit density materials to said input side of said hammermill means;

third conveyor means operably associated with said exit sides of said shredder means and said hammermill means for conveying said shredded light unit density material and said ground high unit density material to said input side of said pulverizer means;

fourth conveyor means operably associated with said exit side fuel component mixing means and said furnace feed means for conveying said pulverized materials to said material separation means;

fifth conveyor means operably interposed between said fuel component mixing means and said furnace feed means for conveying said furnace fuel mixture to said furnace feed means;

sixth conveyor means operably interposed between said fuel component mixing means and said compacting means for transporting said gasifier fuel mixture to said compacting means;

seventh conveyor means operably interposed between said compacting means and said gasifier feed means for conveying said formulated gasifier fuel mixture to said gasifier feed means; and eighth conveyor means operably interposed between said furnace fuel hopper means and said furnace fuel feed means for conveying the furnace fuel mixture to said furnace fuel feed means.

22. The invention according to claim 21 wherein said material conveying means further comprises:

said first, second and third conveyor means comprise substantially flat belt conveyors;

said fourth conveyor means comprises a screw feed conveyor;

said fifth conveyor means comprising a screw feed conveyor operably associated with a bucket elevator conveyor;

said sixth conveyor means comprising a screw feed conveyor operably associated with an elevated climb conveyor;

said seventh conveyor means comprising a substantially flat belt conveyor operably associated with a bucket elevator conveyor.

said eighth conveyor means comprises a screw feed conveyor.

23. The invention according to claim 13 wherein said material segregation means comprises:

blower means operably associated with said exit side of said pulverizer means;

centrifuge means operably associated with said blower means so as to receive said materials from said pulverizer means and separate said pulverized materials from the surrounding air;

at least one distribution chute for receiving said separated pulverized materials;

at least one storage hopper associated with each of said distribution chutes for receiving said separated pulverized materials; and control means operably associated with said centrifuge means and said distribution chutes so as to control direction of said separated pulverized materials into desired storage hoppers.

24. The invention according to claim 23 wherein said fuel component mixing means comprises at least one metering mechanism operably associated with said storage hoppers to release a preselected amount of said pulverized materials contained within said hoppers so as to yield said preselected desired furnace fuel mixture and said desired gasifier fuel mixture formula.

25. The invention according to claim 1 wherein said compacting means comprises one or more hydraulic ram assemblies operably associated with said gasifier means for further densifying said gasifier formulated fuel mixture immediately prior to feeding said fuel mixture into said interior of said gasifier means.

26. The invention according to claim 25 wherein said compacting means further comprises pelletizer means operably associated with said conveying means so as to initially compress said gasifier fuel mixture into pellets between said delivery means and said gasifier feed means.

27. The invention according to claim 25 wherein said hydraulic ram means comprises:

one or more outwardly extending sleeves operably affixed to the outer periphery of said fuel feed tray and communicating with the interior of said gasifier means;

a platten member operably positioned within each of said sleeves;

said platten member having one or more air release vents for releasing entrapped oxygen and nitrogen from said fuel mixture during compaction; and a hydraulically activated piston for selectively extending and retracting said platten member and densifying said gasifier fuel formula mixture to a minimum unit density of 60 $lb/ft^3$.

28. The invention according to claim 25 wherein said furnace means comprises:

said furnace housing;

said furnace housing being positioned proximate to said gasifier for heating a gasifier chamber within same;

a furnace chamber substantially surrounding said gasifier chamber for burning of said furnace fuel within said furnace housing;

said furnace chamber having a substantially cylindrical interior;

a refractory furnace liner substantially lining the interior of said furnace chamber;

furnace fuel intake means for receiving said furnace fuel for burning thereof;

combustion air intake means operably associated with said furnace means for injecting air into said furnace chamber and causing a substantially cyclonic air flow pattern within said furnace chamber; and furnace exhaust means operably associated with said furnace chamber so as to enable removal of furnace fuel gaseous wastes.

29. The invention according to claim 1 wherein the heating of said gasifier means is accomplished by a solar powered furnace substantially surrounding said gasifier means.

30. The invention according to claim 28 wherein said gasifier chamber further comprises:

gasifier mixing means operably positioned within said gasifier chamber so as to mix and circulate said gasifier fuel;

gasifier fuel char removal means operably positioned within said gasifier chamber so as to enable facilitated removal of said gasifier fuel char from said gasifier;

gasifier fuel intake means for receiving said formulated gasifier fuel for pyrolytic gasification thereof, within said gasifier chamber; and synthetic gas escape means operably positioned proximate the top of said gasifier chamber so as to enable said synthetic gas to escape from said gasifier.

31. The invention according to claim 30 wherein said gasifier mixing means comprises:

drive shaft means extending through the interior of said gasifier chamber;

a plurality of paddle members operably positioned about the periphery of said drive shaft means coaxially with the central axis of said gasifier chamber; and motor means operably associated with said drive shaft means, so as to rotate said drive shaft means and said paddle members within said gasifier chamber.

32. The invention according to claim 30 wherein said gasifier fuel char removal means comprises:

a char removal opening proximate to the lower portion of said gasifier chamber;

a char removal tube operably communicating with said gasifier chamber char removal opening so as to enable said fuel char to pass from said gasifier chamber to the interior of said char removal tube;

air sealing means operably associated with said char removal tube to prevent the undesired entry of air into said gasifier chamber through said char removal tube;

solid removal means operably associated with said char removal tube proximate an open first end of said tube for conveying said gasifier char from said furnace means; and hydraulic cylinder means operably positioned within the interior of said char removal tube, proximate and opposite second end of said tube, so as to enable said hydraulic cylinder means to push said gasifier fuel char from said char removal tube to said solid removal means.

33. The invention according to claim 32 wherein said solid removal means comprises:

an auger conveyor; and motor means operably associated with said auger conveyor for rotating said auger conveyor 34. The invention according to claim 33 wherein said air sealing means comprises a one-way flap valve operably positioned within the interior of said char removal tube.

35. The invention according to claim 30 wherein said gasifier fuel intake means comprises one or more gasifier fuel feed ports positioned about the periphery of and operably communicating with the interior of said gasifier chamber proximate the top portion thereof.

36. The invention according to claim 30 wherein said synthetic gas escape means comprises said gasifier chamber having an opening proximate the top thereof.

37. The invention according to claim 28 wherein said furnace means further comprises:

grate means operably positioned along the bottom surface of said furnace chamber;

wiper means operably associated with said grate means so as to enable substantially continuous clearing of said grate means and permit said furnace fuel ash to pass therethrough;

solid removal means operably positioned below said grate means so as to receive said furnace fuel ash and convey it away from said furnace means;

said furnace chamber having an exhaust opening along the back side, and proximate the top, of said furnace chamber;

an exhaust tube operably communicating with said furnace chamber opening; and damper blade valve means operably positioned within said exhaust tube so as to enable selective blockage of said exhaust tube.

38. The invention according to claim 28 wherein said combustion air intake means comprises:

said furnace chamber having an opening proximate the bottom thereof capable of accommodating a blower tube for said injection of combustion air into said furnace chamber; and said furnace chamber opening being further capable of accommodating insertion and receipt of a flame or ignition device for initially igniting said furnace fuel material.

39. The invention according to claim 28 wherein said furnace fuel feed means comprises:

said chamber having a furnace fuel intake opening proximate the top of said furnace chamber;

said furnace fuel feed conduit operably connected to said furnace fuel intake opening;

said furnace fuel feed conduit having an upwardly exposed open portion;

a furnace fuel feed hopper operably attached to said upwardly exposed open portion of said furnace fuel feed conduit;

auger conveyor means operably positioned within the interior of said furnace fuel feed conduit; and motor means operably associated with said auger conveyor means so as to drive said auger conveyor means and transfer said furnace fuel from said furnace fuel feed hopper to said furnace fuel intake opening.

40. The invention according to claim 35 wherein said gasifier fuel feed means comprises:

gasifier fuel tray means operably positioned about the upper, top periphery of said furnace housing;

said gasifier fuel tray having a substantially hollow upper chamber;

said gasifier fuel tray having a substantially hollow lower chamber;

gasifier paddle means operably positioned within the interior of said upper chamber of said gasifier fuel tray for moving said gasifier fuel about said interior;

said gasifier fuel tray upper chamber having an interior channel;

one or more substantially vertical chutes formed in said interior channel;

gasifier fuel tray lower chamber having one or more lower compaction areas therein;

said substantially vertical chutes communicating with said lower compaction areas; and said hydraulic ram means operably positioned proximate to said lower compaction areas so as to densify and inject said formulated gasifier fuel into said gasifier chamber through one of said gasifier fuel feed ports.

41. The invention according to claim 40 wherein said gasifier paddle means comprises:

a plurality of paddle members positioned substantially across the width of the interior of said upper chamber of said gasifier fuel tray in said interior channel;

gear means operably affixed to said plurality of paddle members; and motor means operably associated with said gear means so as to drive said paddle members along said interior of said gasifier fuel tray.

42. The invention according to claim 41 wherein said gear means comprises:

one or more gear members, continuous chain member operably moved within said channel by said one or more gear members and operably attached to said plurality of paddle members, said one or more gear members including a primary gear operably attached to said motor means and engaging said chain member so as to move said chain member in response to rotation of said primary gear; and one or more secondary gears rotatably affixed within said upper channel so as to engage and support said chain member therein.

43. The invention according to claim 36 wherein said synthetic gas collection means comprises:

a synthetic gas exhaust pipe operably affixed at a first end to said gasifier chamber, so as to communicate with said synthetic gas escape opening in said gasifier chamber;

particulate removal means operably associated with said second end of said pipe for initial filtering of said synthetic gas;

synthetic gas cooler means operably associated with said particulate removal means for cooling of said synthetic gas so as to substantially remove any liquid hydrocarbons present in said synthetic gas, after said initial filtration of said synthetic gas;

secondary filtration means operably associated with said synthetic gas cooler means for secondary filtration of said synthetic gas after removal of said liquid hydrocarbons;

pump means operably associated with said synthetic filtration means for drawing, under slight negative pressure, said synthetic gas from said gasifier chamber; and one or more synthetic gas storage tanks operably associated with said pump means for storing said synthetic gas drawn from said gasifier chamber, in compressed form or utilizing said synthetic gas on site.

44. The invention according to claim 43 wherein said particulate removal means comprises a filter assembly having fabric material media.

45. The invention according to claim 43 wherein said synthetic gas cooler means comprises a cooling tube assembly for cooling the synthetic gas passing therethrough.

46. The invention according to claim 43 wherein said filtration means comprises a plurality of triple element industrial media filters.

47. The invention according to claim 43 wherein said pump means comprises a hydraulically driven vacuum/pressure pump.

48. The invention according to claim 1 wherein said formulated gasifier fuel comprises a mixture of approximately 1% to 25% by weight of specified plastic product materials with approximately 99% to 75% by weight, respectively, consisting of specified paper product materials.

49. The invention according to claim 1 wherein said formulated gasifier fuel comprises a mixture of approximately 26% to 50% by weight of specified plastic product materials with approximately 74% to 50% by weight, respectively, consisting of specified product materials.

50. The invention according to claim 1 wherein said formulated gasifier fuel comprises a mixture of approximately 50% to 99% by weight of specified plastic product materials with approximately 49% to 1% by weight, respectively, consisting of specified paper product materials.

51. The invention according to claim wherein said gasifier fuel comprises only plastic product materials.

52. The invention according to claim 28 wherein said furnace liner is made of a refractory material.

* * * * *